US006622937B2

(12) United States Patent
Schroeder et al.

(10) Patent No.: US 6,622,937 B2
(45) Date of Patent: Sep. 23, 2003

(54) SPRAY GUN HANDLE AND TRIGGER MECHANISM

(75) Inventors: Joseph G. Schroeder, North Royalton, OH (US); Jeffery Dailidas, Barrington, IL (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 10/085,554

(22) Filed: Feb. 28, 2002

(65) Prior Publication Data

US 2002/0100817 A1 Aug. 1, 2002

Related U.S. Application Data

(63) Continuation of application No. 08/921,721, filed on Aug. 29, 1997, now Pat. No. 6,375,094.

(51) Int. Cl.[7] ..... B05B 15/02

(52) U.S. Cl. ..... 239/113; 239/706; 239/526

(58) Field of Search ..... 239/690, 697, 239/698, 704–706, 525, 526, 407, 413, 417.5, 433, 106, 112

(56) References Cited

U.S. PATENT DOCUMENTS

| | | | | |
|---|---|---|---|---|
| 3,463,120 A | * | 8/1969 | Wallis | 118/308 |
| 3,698,641 A | * | 10/1972 | Lonardo | 239/434 |
| 3,801,009 A | | 4/1974 | Marshall, III | |
| 3,940,061 A | | 2/1976 | Gimple et al. | |
| 3,941,964 A | | 3/1976 | Yoder | |
| 3,964,683 A | | 6/1976 | Gimple | |
| 4,176,793 A | | 12/1979 | Heinrich | |
| 4,248,379 A | | 2/1981 | Hollstein et al. | |
| 4,375,585 A | | 3/1983 | Lee | |
| 4,380,320 A | | 4/1983 | Hollstein et al. | |
| 4,765,544 A | | 8/1988 | Kuhn et al. | |
| 4,934,607 A | | 6/1990 | Lasley | |
| 4,993,645 A | | 2/1991 | Buschor | |
| 4,995,560 A | | 2/1991 | Lasley et al. | |
| 5,056,720 A | | 10/1991 | Crum et al. | |
| 5,221,050 A | | 6/1993 | Jeffries et al. | |
| 5,341,989 A | | 8/1994 | Fulkerson et al. | |
| 5,395,046 A | * | 3/1995 | Knobbe et al. | 239/289 |
| 5,620,138 A | | 4/1997 | Crum | |
| 5,639,027 A | | 6/1997 | Fritz | |
| 5,829,681 A | | 11/1998 | Hamel et al. | |
| 6,375,094 B1 | | 4/2002 | Schroeder et al. | |

FOREIGN PATENT DOCUMENTS

| | | |
|---|---|---|
| DE | 296 08 899 | 8/1996 |
| EP | 0 572 236 | 5/1993 |
| EP | 0 611 603 | 2/1994 |
| EP | 0 718 042 | 6/1996 |

* cited by examiner

*Primary Examiner*—Christopher Kim
(74) *Attorney, Agent, or Firm*—Calfee, Halter & Griswold LLP

(57) ABSTRACT

A spray gun includes a handle portion and an extension portion. A nozzle is connected with an outer end of the extension portion. An electrode assembly is disposed in the extension portion to establish an electrical field to electrostatically charge particles of coating material. A coating material flow control member and a purge air flow control member are disposed on the handle portion. Operation of either one of the two flow control members actuates a membrane switch assembly. Operation of the purge air flow control member directs the flow of air to the coating material passage in the extension portion to remove excess coating material from the passage and from the nozzle. Different size hand grips may be mounted on the handle portion of the spray gun to accommodate operators having hands of different sizes. Passages for air and electrical conductors are formed in the handle and extension portions of the spray gun by cooperation between outer side walls of the handle and extension portions and inner wall structures. A voltage multiplier unit in the extension portion of the spray gun is exposed to a flow of air to transfer heat from the voltage multiplier.

9 Claims, 9 Drawing Sheets

SPRAY GUN HANDLE AND TRIGGER MECHANISM

RELATED APPLICATIONS

This application is a continuation of U.S. patent application Ser. No. 08/921,721, filed Aug. 29, 1997, now U.S. Pat. No. 6,375,094, the specification of which is fully incorporated by reference herein.

BACKGROUND OF THE INVENTION

The present invention relates to an apparatus which applies coating material to an object, and more specifically, to a spray gun which directs a flow of the electrostatically charged coating material toward the object.

Known spray guns have previously been used to direct coating material toward an object. One known spray gun for directing a flow of coating material toward an object is constructed in accordance with U.S. Pat. No. 5,056,720 issued Oct. 15, 1991. Although a spray gun constructed in accordance with the aforementioned patent is satisfactory in its construction and mode of operation, it is desirable to simplify the construction of the spray gun, increase operator comfort during use of the spray gun, and increase the ability of the spray gun to apply a uniform coating of material to an object.

SUMMARY OF THE INVENTION

An improved apparatus for use in applying coating material to an object includes a spray gun having a handle portion and an extension portion which extends from the handle portion. A nozzle is connected with the extension portion to direct a flow of coating material toward the object. A coating material flow control member is disposed on the handle portion of the spray gun to control the flow of coating material. An electrode may be provided adjacent to the nozzle to electrostatically charge the coating material.

In accordance with one of the features of the present invention, an air flow control member is also disposed on the handle portion. The air flow control member is manually operable to direct a flow of air through coating material passages and through the nozzle to remove excess coating material from the passages and/or nozzle.

In accordance with another feature of the invention, a membrane switch assembly is actuated upon manual actuation of one of the flow control members. The membrane switch assembly includes a switch element which is disposed between layers of electrically insulating material. Upon manual actuation of a flow control member, the switch element is deflected to initiate a control function.

In accordance with another feature of the invention, hand grips of different sizes may be utilized with the handle portion of the spray gun. The hand grips of different sizes enable the spray gun to be adapted for manual engagement by operators having hands of different sizes. Each of the hand grips may be formed of an electrically conductive material and, when connected with the handle portion of the spray gun, is connected with an electrical ground.

In accordance with another feature of the invention, passages in the handle and/or extension portions of the spray gun are formed by cooperation between an outer wall of the spray gun and an inner wall structure. The inner wall structure may be, at least partially, formed as one piece with the outer wall of the spray gun. The inner wall structure may advantageously be utilized to form one or more passages which may receive purge air, electrode wash air, or electrical conductors.

In accordance with another feature of the invention, a voltage multiplier unit is cooled by a flow of air. To promote a transfer of heat from the voltage multiplier unit to the air, a portion of an outer surface area on the voltage multiplier unit is exposed to the flow of air through a passage in the spray gun. The voltage multiplier unit is advantageously positioned to balance the spray gun.

It should be understood that the foregoing features may be used either separately or in various combinations to provide an improved spray gun. The spray gun may be utilized to direct electrostatically charged coating materials or other coating materials toward an object. The coating materials may be liquids or solids (powder).

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

General Description

Figure 1:
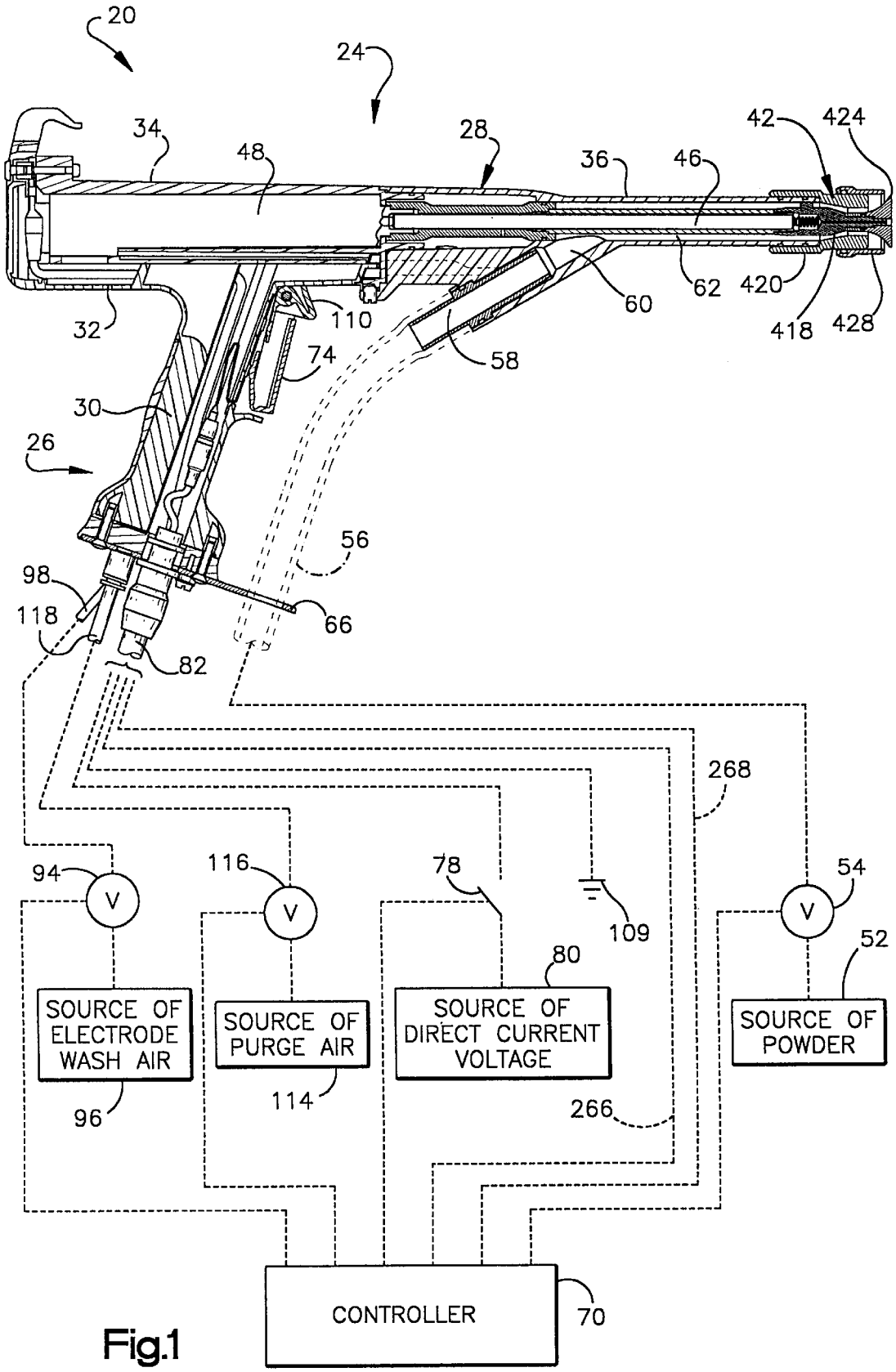
FIG. 1 is a schematic illustration of an apparatus which is utilized to apply coating material to an object.

An apparatus 20 (FIG. 1) is utilized to apply coating material to an object (not shown). In the illustrated embodiment of the invention, the coating material applied to the object is electrostatically charged powder. However, it is contemplated that an apparatus constructed in accordance with the present invention could be utilized to apply coating materials other than electrostatically charged powder to an object. For example, the apparatus could be constructed so as to enable it to be used to apply liquid coating materials to an object.

The apparatus 20 includes a spray gun 24 which is constructed in accordance with the present invention. The spray gun 24 (FIGS. 1 and 2) includes a manually engageable handle portion 26 and an extension portion 28. The handle portion 26 includes a base section 30 which is integrally molded as one piece of an electrically insulating (polymeric) material.

The extension portion 28 includes a base section 32 which is integrally molded as one piece with the handle portion 26. The extension portion 28 also includes a housing section 34 which is connected with the base section 32. The housing section 34 is integrally molded as one piece of an electrically insulating (polymeric) material. The extension portion 28 further includes a barrel section 36 is connected with the base section 32 and housing section 34. The barrel section 36 is integrally molded as one piece of an electrically insulating (polymeric) material.

A known nozzle assembly 42 is disposed at the outer end of the barrel section 36. During operation of the spray gun 24, the nozzle assembly 42 directs a flow of coating material toward an object to be coated.

An electrode assembly 46 (FIG. 2) is disposed in the extension portion 28 of the spray gun 24. The electrode assembly 46 extends between the nozzle assembly 42 and a voltage multiplier unit 48. The voltage multiplier unit 48 and the electrode assembly 46 cooperate to establish an electrical field to electrostatically charge coating material conducted toward an object.

Coating material, specifically, powder entrained in a flow of air, is conducted from a source 52 (FIG. 1) of powder to the spray gun 24. Thus, powder entrained in a flow of air is conducted through a valve 54 to a coating material supply conduit 56. The flow of air entrained powder is conducted from the coating material supply conduit 56 through an adapter 58 (FIGS. 1 and 2) to an inlet passage 60 (FIG. 2) in the extension portion 28 of the spray gun 24. Although the valve 54 is shown schematically as controlling flow of air entrained powder to the spray gun 24, in one embodiment of the invention, the valve 54 controls a flow of air to a powder pump.

The inlet passage 60 is connected with a main coating material passage 62 in the barrel section 36 of the extension portion 28 of the spray gun 24. The main coating material passage 62 conducts the air entrained powder to the nozzle assembly 42. A coating material conduit bracket 66 is connected with an outer end of the handle portion 26 (FIGS. 2 and 3) and engages the coating material supply conduit 56. The coating material bracket 66 is formed of an electrically insulating material.

When coating material is to be conducted to the spray gun 24, a controller 70 (FIG. 1) operates the valve 54 to enable air entrained powder to be conducted from the source 52. The source 52 of powder may have many different constructions. However, it is believed that it may be preferred to construct the source 52 of powder in a manner similar to that disclosed in U.S. Pat. No. 4,987,001 issued Jan. 22, 1991 which is incorporated herein by this reference thereto. Of course, other known powder supply systems could be utilized if desired. In fact, coating materials other than powder could be utilized if desired. For example, liquid coating materials could be utilized.

Figures 2, 3:
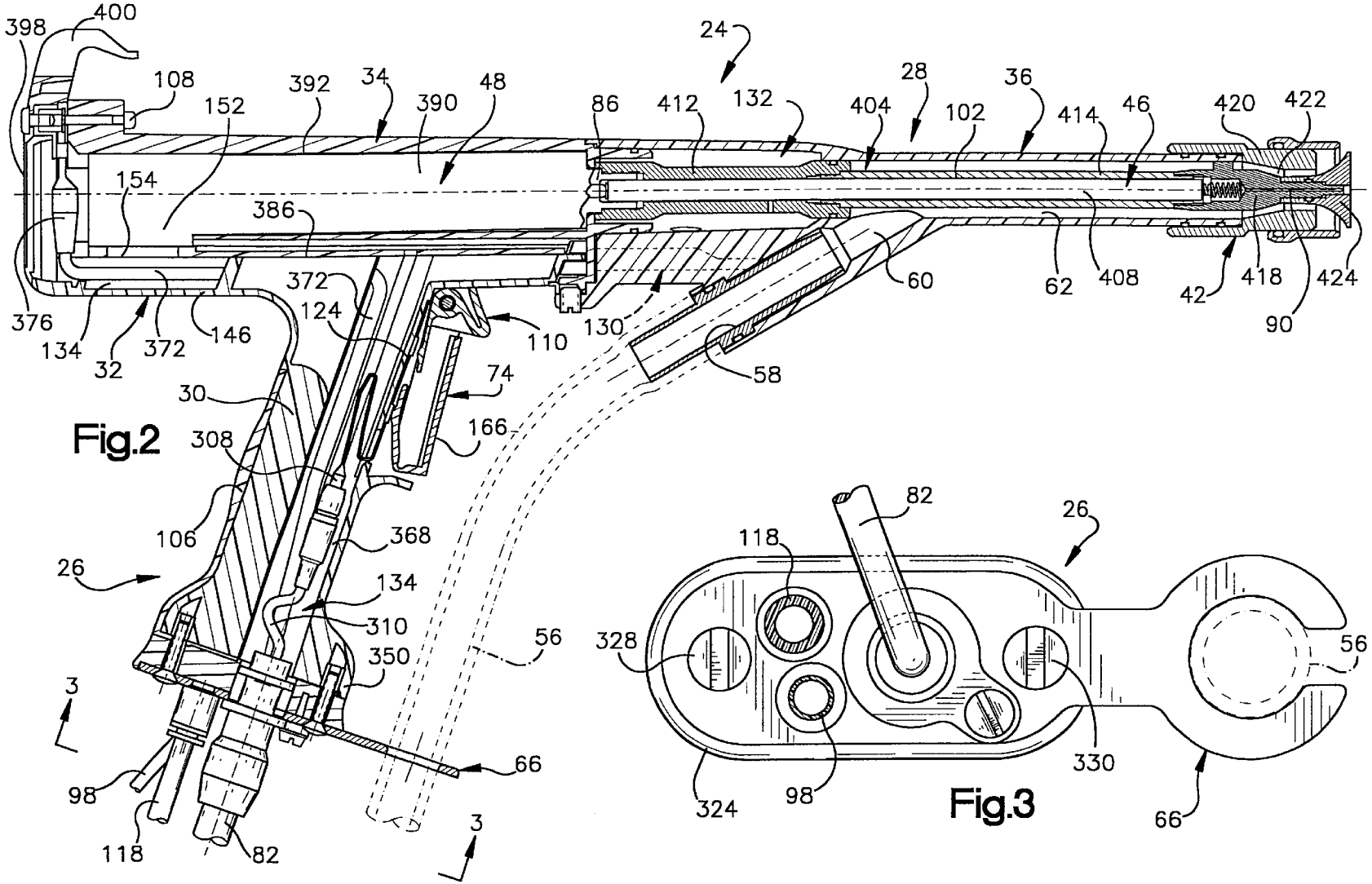
FIG. 2 is an enlarged sectional view of an improved spray gun which forms a portion of the apparatus of FIG. 1.
FIG. 3 is an enlarged plan view, taken generally along the line 3—3 of FIG. 2, illustrating the manner in which air conduits and an electrical cable are connected with a handle portion of the spray gun of FIG. 2.

The flow of coating material from the source 52 to the nozzle assembly 42 is controlled by a coating material flow control member or main trigger 74 (FIGS. 1 and 2). The coating material flow control member 74 is mounted on the handle portion 26 of the spray gun 24. The coating material flow control member 74 is manually actuatable by an operator of the spray gun 24.

Upon manual actuation of the coating material flow control member 74, the controller 70 (FIG. 1) actuates the valve 54 from a closed condition to an open condition. This enables air entrained powder to flow through the coating material supply conduit 56 to the extension portion 28 of the spray gun 24. The coating material flows from the extension portion 28 of the spray gun 24 through the nozzle assembly 42.

Particles of powder in the flow of coating material are electrostatically charged by the electrode assembly 46 as the flow of coating material moves away from the nozzle assembly 42. In the illustrated embodiment of the invention, the nozzle assembly 42 and electrode assembly 46 have the same general construction as is disclosed in U.S. Pat. No. 5,056,720 issued Oct. 15, 1991 which is incorporated herein by this reference thereto. However, it should be understood that the nozzle assembly 42 and the electrode assembly 46 could have a different construction if desired. For example, the nozzle assembly 42 and electrode assembly 46 could have the construction disclosed in U.S. patent application Ser. No. 08/710,189 filed Sep. 13, 1996 by Alan J. Knobbe and Terrence M. Fulkerson and entitled "Particle Spray Apparatus and Method".

If the spray gun 24 is constructed and utilized to apply coating material which is electrically charged before being supplied to the spray gun, the electrode assembly 46 could include a "floating" (i.e., isolated) electrode adjacent to the nozzle assembly 42 in the manner disclosed in U.S. patent application Ser. No. 08/359,808 filed Feb. 28, 1995 by Ronald J. Hartle and entitled "Electrostatic Coating System Including Improved Spray Gun For Conductive Paints". Although the apparatus 20 is constructed and utilized to apply electrostatically charged coating materials to objects, it is contemplated that one or more of the features of the present invention may be utilized with spray guns which apply coating materials which are not electrostatically charged.

Since the air entrained powder from the source 52 (FIG. 1) of powder is not electrostatically charged when the controller 70 effects operation of the valve 54 to an open condition, the controller simultaneously energizes the voltage multiplier unit 48 to enable the electrode assembly 46 to establish an electrical field adjacent to the nozzle assembly 42. To energize the voltage multiplier unit 48, the controller 70 effects operation of a switch 78 from the illustrated open condition to a closed condition to connect a source 80 of low direct current voltage with the voltage multiplier unit 48 through an electrical cable 82.

The voltage multiplier unit 48 includes an oscillator which converts the low voltage direct current from the source 80. A step-up transformer in the voltage multiplier unit 48 increases the voltage from the oscillator. A multiplier circuit in the voltage multiplier unit 48 increases the voltage to a very high (80,000 to 100,000 volts) voltage.

An output 86 (FIG. 2) from the voltage multiplier unit 48 applies this high voltage to one end of the electrode assembly 46. The high voltage is conducted to a cylindrical metal electrode element 90 which is disposed adjacent to the nozzle assembly 42 and forms part of the electrode assembly 46. The electrode element 90 establishes an electrical field which charges particles of powder exiting from the nozzle assembly 42.

Figure 14:
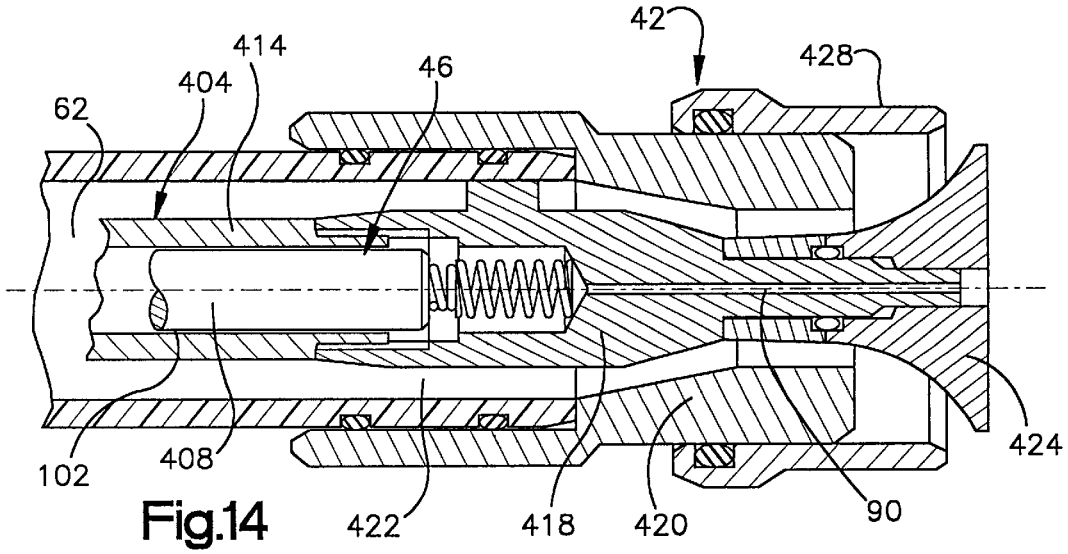
FIG. 14 (on sheet 5 of the drawings) is an enlarged fragmentary sectional view of an outer end of the extension portion of the spray gun, a nozzle assembly, and a portion of an electrode assembly.
Figure 13:
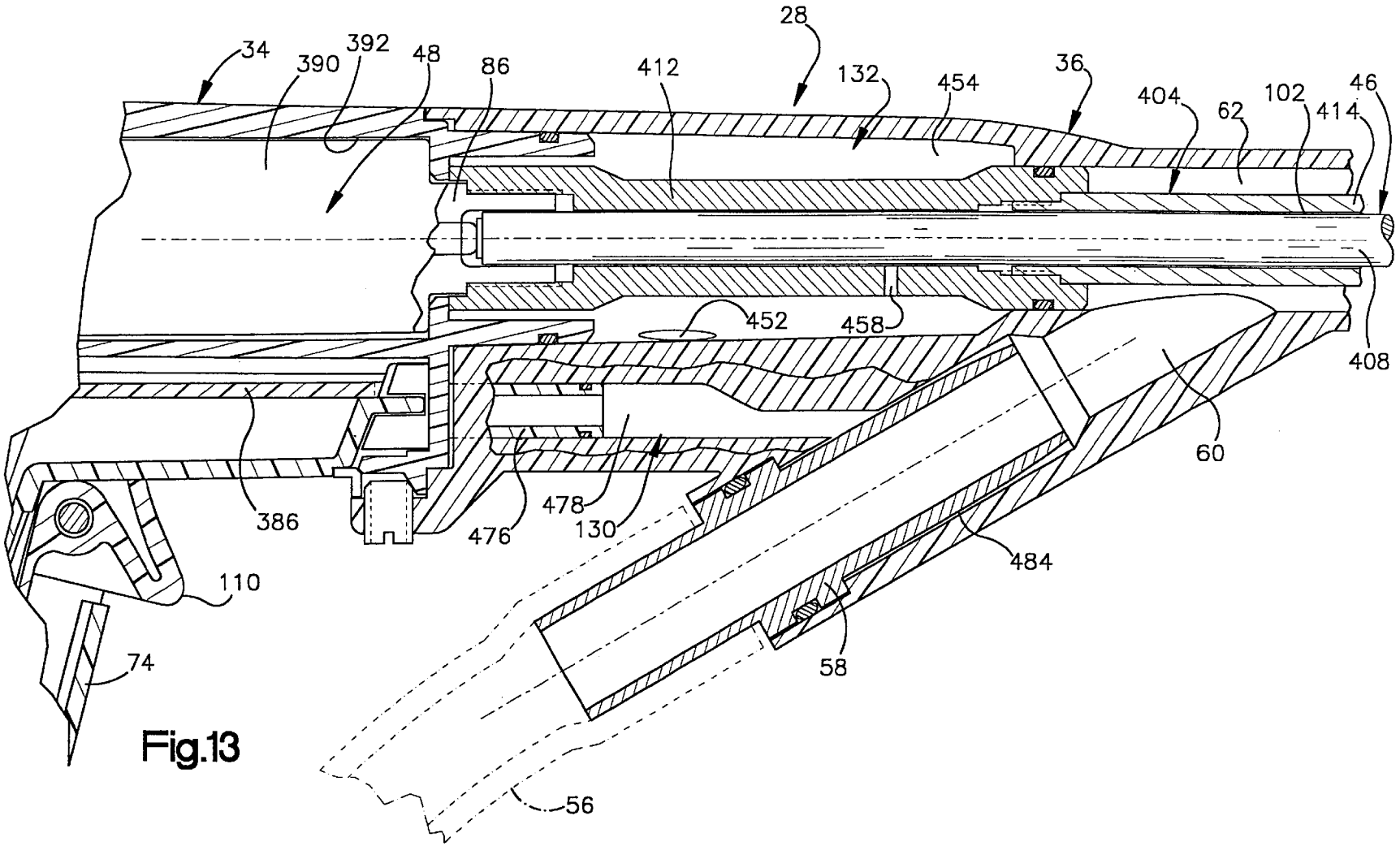
FIG. 13 is an enlarged fragmentary sectional view of a portion of the spray gun of FIG. 2 and illustrating the manner in which a purge air passage is connected with a coating material passage in the extension portion of the spray gun.

Simultaneously with opening of the valve 54 (FIG. 1) and closing of the switch 78, the controller 70 operates a valve 94 to an open condition to enable air under pressure from a source 96 of electrode wash air to flow through a conduit 98 to handle portion 26 of the spray gun 24. Electrode wash air is conducted from the handle portion 26 of the spray gun 24 through the extension portion 28 of the spray gun. As the electrode wash air flows through the extension portion 28 of the spray gun, the electrode wash air flows through a combined electrical conductor and air passage 102 (FIGS. 13 and 14).

The passage 102 has an annular cross sectional configuration and extends around the electrode assembly 46. In addition, the passage 102 extends axially along the electrode assembly 46 past the electrode element 90 to the environment adjacent to the nozzle assembly 42. The flow of electrode wash air through the passage 102 washes away or removes contaminants which may accumulate around the electrode assembly 46. The contaminants may be the result of an interaction between components of the spray gun 24 and the electrode assembly 46 due to the high voltage in the electrode assembly.

A manually engageable hand grip 106 and an ion collector 108 on the spray gun 24 (FIG. 2) are continuously connected with an electrical ground 109 (FIG. 1) through the electrical cable 82. The hand grip 106 is disposed on the electrically insulating base section 30 of the handle portion 26. The ion collector 108 is disposed on the electrically insulating housing section 34.

In accordance with one of the features of the present invention, a purge air flow control member or secondary trigger 110 is mounted on the handle portion 26. The purge air flow control member 110 is manually actuatable to cause the controller 70 (FIG. 1) to initiate a flow of air through the coating material inlet passage 60 and main coating material passage 62 (FIG. 2). At this time, the coating material flow control member or main trigger 74 is in an unactuated condition so that the flow of coating material is interrupted.

The flow of purge air through the coating material passages 60 and 62 and nozzle assembly 42 (FIG. 2) is effective to remove excess coating materials from the spray gun 24. Thus, during use of the spray gun 24, coating material, that is, powder, may adhere to the inner surfaces of the coating material passages 60 and 62 and/or nozzle assembly 42. The flow of purge air through the coating material passages 60 and 62 and nozzle assembly 42 is effective to remove this excess powder.

The purge air is conducted from a source 114 (FIG. 1) through a control valve 116 and conduit 118 to the handle portion 26 of the spray gun 24 (FIGS. 1, 2 and 3). When the purge air flow control member 110 is actuated to signal the controller 70 to initiate the flow of purge air through the valve 116, the coating material flow control member 74 is in an unactuated condition. At this time, the coating material flow control valve 54 is closed to interrupt the flow of coating material. The switch 78 is open to disconnect the voltage multiplier unit 48 from the source 80 of low voltage direct current. In addition, the electrode wash air flow control valve 94 is closed.

In accordance with another feature of the invention, a membrane switch assembly 124 (FIGS. 5 and 6) is provided to signal the controller 70 whenever either the coating material flow control member 74 or purge air flow control member 110 (FIG. 5) is actuated. The membrane switch assembly 124 is formed as a unit which is easily installed on the handle portion 26 of the spray gun 24. The membrane switch assembly 124 is a sealed unit so that contaminants can not enter the switch assembly. Therefore, the spray gun 24 can be utilized for a relatively long period of time without contaminants entering the membrane switch assembly 124 and causing failure of the switch assembly.

In accordance with another feature of the invention, hand grips of different sizes are provided for the handle portion 26 of the spray gun 24. The hand grips are of different sizes to accommodate operator hands of different sizes. Thus, the hand grip 106 (FIG. 4) is relatively small, while another hand grip 126 is relatively large. When an operator of the spray gun 24 has relatively small hands, it is contemplated that the small hand grip 106 will be mounted on the handle portion 26 of the spray gun 24. When an operator has relatively large hands, it is contemplated that the large hand grip 126 will be mounted on the handle portion 26 of the spray gun.

The hand grips 106 and 126 are both formed of an electrically conductive material. When a selected one of the hand grips 106 or 126 is mounted on the handle portion 26 of the spray gun 24, the hand grip is continuously connected with the electrical ground 109 (FIG. 1) through the electrical cable 82. This results in the operator being able to select the hand grip 106 or 126 which is comfortable for him/her and to enable the operator to be electrically grounded while the operator is holding the spray gun 24.

In accordance with another feature of the invention, air and electrical passages are formed in the handle portion 26 and extension portion 28 of the spray gun 24 by cooperation between inner wall structures and outer walls of the spray gun. Thus, a purge air passage 130 (FIG. 10) and an electrode wash air passage 132 are formed in the handle portion 26. In addition, an electrical conductor passage 134 is formed in the handle portion 26.

The passages 130, 132 and 134 extend through the handle portion 26 into the extension portion 28. The passages 130, 132 and 134 are formed by an inner wall structure 138 (FIG. 10) which is disposed within the handle portion 26 and cooperates with an outer wall 140 of the handle portion to form the passages. The inner wall structure 138 is integrally molded as one piece with the outer wall 140 of the handle portion 26.

The purge air passage 130, electrode wash air passage 132, and electrical conductor passage 134 (FIG. 10) extend through the base section 32 (FIGS. 9 and 11) of the extension portion 28 and through the barrel section 36 of the extension portion (FIGS. 2, 9, 13 and 14). In the extension portion 28, portions of the purge air passage 130, electrode wash air passage 132, and electrical conductor passage 134 are formed by cooperation between an inner wall structure 144 of the base section 32 (FIG. 11) and an outer wall 146 of the base section 32. Portions of the inner wall structure 144 in the base section 32 are integrally molded as one piece with the outer wall 146 of the base section of the extension portion 28.

Figure 11:
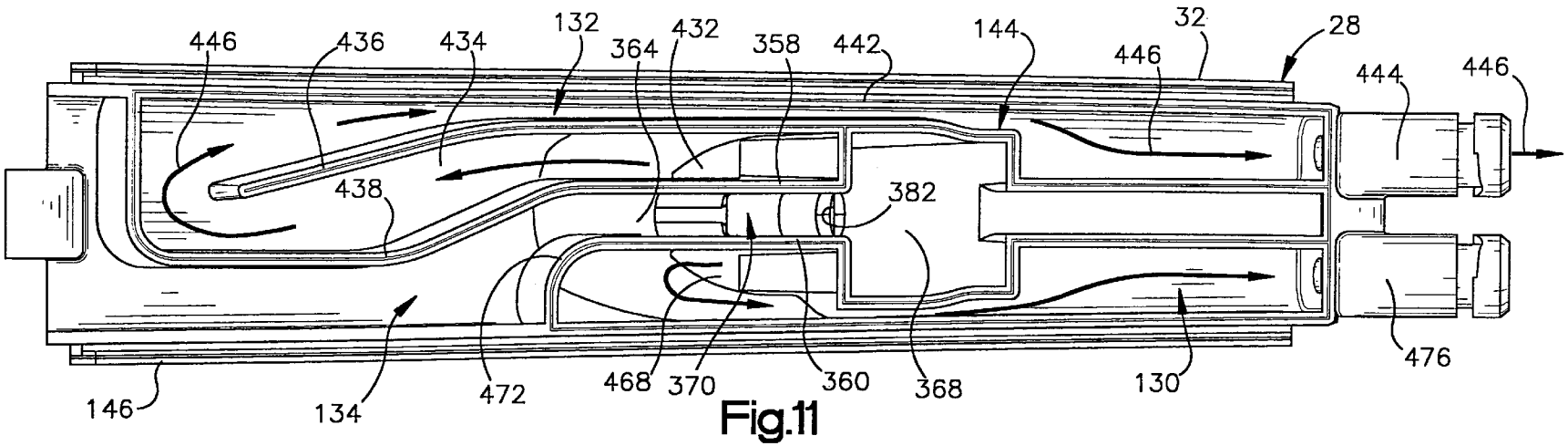
FIG. 11 is a plan view, taken generally along the line 11—11, illustrating the manner in which passages are formed by cooperation between an outer wall and an inner wall structure of an extension portion of the spray gun.
Figure 12:
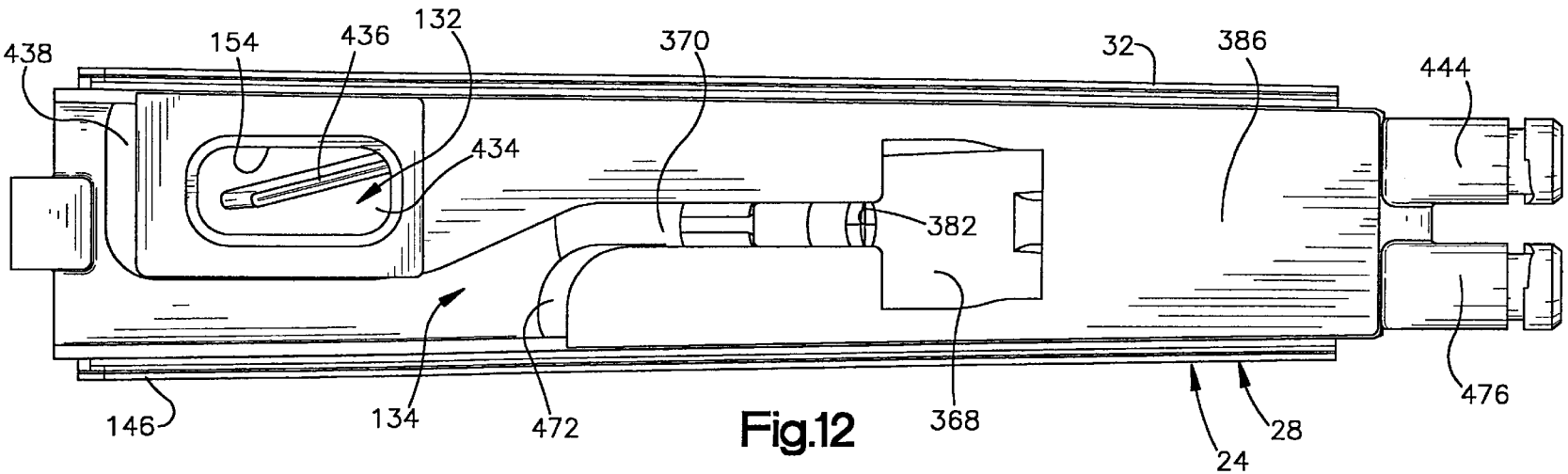
FIG. 12 is a plan view, generally similar to FIG. 11, illustrating the manner in which a panel is positioned on the extension portion of the spray gun of FIG. 11.

In accordance with another feature of the invention, the voltage multiplier unit 48 (FIG. 2) is cooled by the flow of electrode wash air through the electrode wash air passage 132 (FIG. 11). The voltage multiplier unit 48 has an end portion 152 (FIG. 4) which is disposed over an opening 154 (FIG. 12) to the electrode wash air passage 132. Therefore, a surface of the voltage multiplier unit 48 is exposed to the flow of electrode wash air at the opening 154. The electrode wash air impinges directly against a surface of the voltage multiplier unit 48. Heat is transferred from the exposed surface of the voltage multiplier unit 48 to the flow of electrode wash air.

In accordance with another feature of the invention, the spray gun is balanced to promote operator comfort. Thus, the center of gravity of the extension portion 28 of the spray gun 24 is disposed above (as viewed in FIG. 2) the handle portion 26. This promotes operator comfort during use of the spray gun for a relatively long period of time.

Coating Material and Purge Air Flow Control Members

The coating material flow control member or main trigger 74 (FIG. 2) and purge air flow control member or secondary trigger 110 are mounted adjacent to each other on the handle portion 26 of the spray gun 24. The coating material flow control member 74 (FIG. 5) includes a rectangular body 162 having a front wall 164 with a rectangular major side surface 166 which faces toward the nozzle assembly 42 (FIG. 2). The major side surface 166 is engageable by fingers on a hand of an operator to actuate the coating material flow control member 74. A longitudinal central axis of the major side surface 166 intersects a longitudinal central axis of the extension portion 28.

In addition, the generally rectangular body 162 of the coating material flow control member 74 includes a pair of parallel side walls 168 and 170 (FIG. 4) which extend perpendicular to the rectangular front wall 164. A pair of parallel arm sections 172 and 174 extend upward (as viewed in FIG. 4) from the side walls 168 and 170. The arm sections have axially aligned openings through which a mounting pin 178 extends.

The mounting pin 178 supports the coating material 30 flow control member 74 for pivotal movement in a rectangular recess 182 (FIG. 5) formed in the base section of the handle portion 26 of the spray gun 24. The rectangular recess 182 has a longitudinal central axis which extends perpendicular to the central axis of the mounting pin 178 and intersects the central axis of the extension potion 28. The coating material flow control member 74 is pivotal, about the mounting pin 178, under the influence of force manually applied against the outer side surface 166 on the front wall 164 of the coating material flow control member.

A leaf spring 186 is molded as one piece with the body 162 of the coating material flow control member 74. The leaf spring 186 engages the membrane switch assembly 124 and is effective to urge the coating material flow control member 74 outward, that is, toward the right as viewed in FIG. 5, to an unactuated condition. Upon manual application of force against the outer side surface 166 of the coating material flow control member 74, an arcuate projection 188 on the leaf spring 186 is pressed against the membrane switch assembly 124. As force is manually applied against the front wall 164 of the flow material flow control member 74, the leaf spring 186 is resiliently deflected. As this occurs, the force applied by the projection 188 increases and becomes sufficient to effect actuation of the membrane switch assembly 124.

The purge air flow control member or secondary trigger 110 (FIG. 5) is disposed directly above the coating material flow control member 74 on the handle portion 26 of the spray gun 24. The purge air flow control member 110 is mounted in the recess 182 between the coating material flow control member 74 and extension portion 28 of the spray gun. The purge air flow control member 110 has a generally triangular body 192 with an arcuate front wall 194.

A rectangular outer side surface 196 is disposed on the front wall 194 and faces toward the nozzle assembly 42 (FIG. 2). A longitudinal central axis of the front wall 194 of the purge air flow control member 110 is skewed at an acute angle to the longitudinal central axis of the coating material flow control member 74 and intersects the central axis of the extension portion 28. The front wall 194 of the purge air flow control member 110 is offset from the front wall 164 of the coating material flow control member 74 in a direction toward the nozzle assembly 42.

Figure 4:
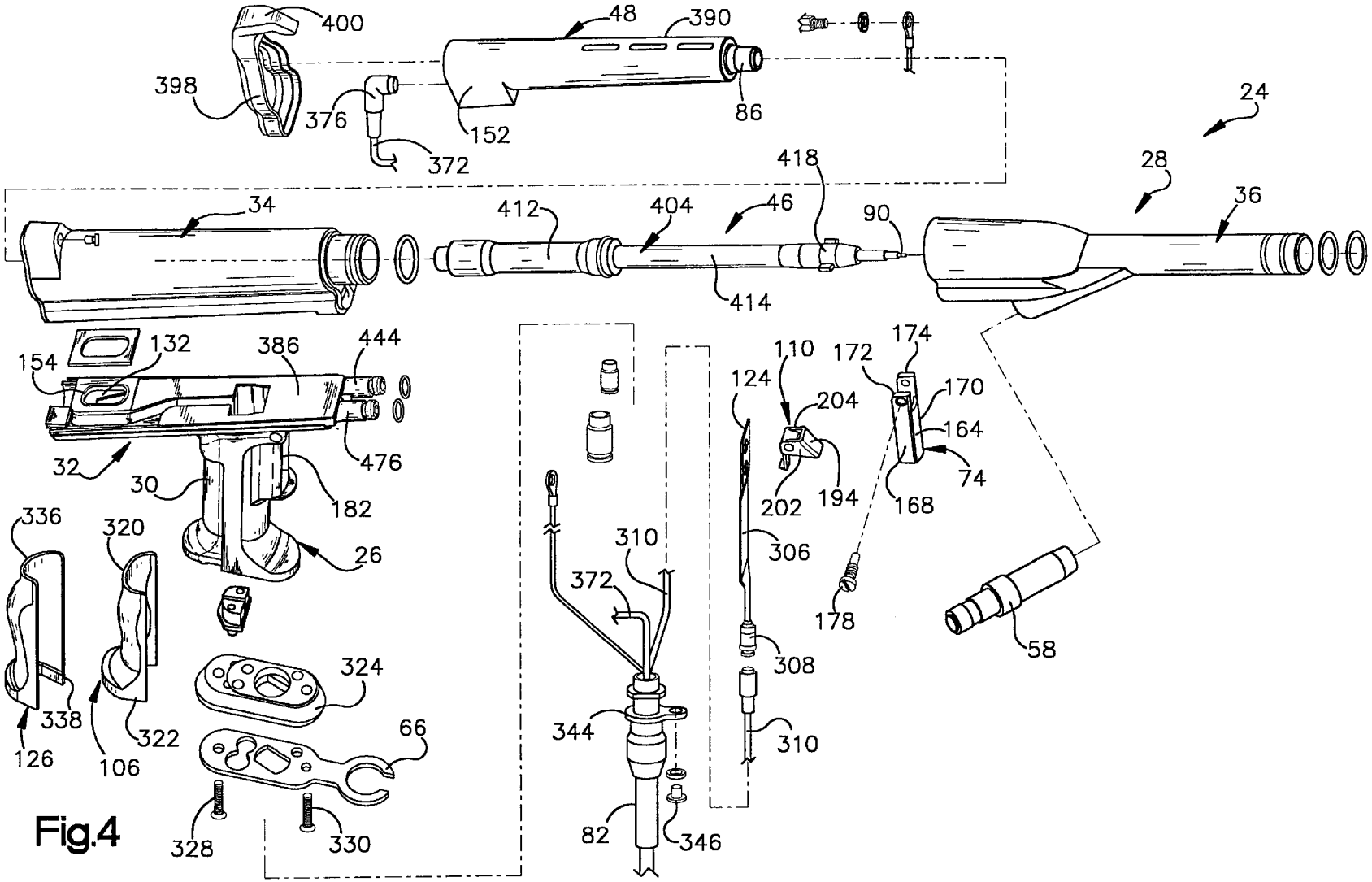
FIG. 4 is an exploded view illustrating components of the spray gun of FIG. 2.

The purge air flow control member 110 has a pair of parallel side walls 202 and 204 (FIG. 4). The side walls 202 and 204 on the purge air flow control member 110 are enclosed by and are disposed in a side-by-side relationship with the side walls 172 and 174 on the coating material flow control member 74. The mounting pin 178 extends through axially aligned openings in the side walls 202 and 204. Thus, the purge air flow control member 110 and the coating material flow control member 174 are both pivotally mounted on the same mounting pin 178 (FIGS. 4 and 5) for pivotal movement about a common axis.

The purge air flow control member 110 includes a leaf spring 208 (FIG. 5) which is molded as one piece with the body 192 of the purge air flow control member. The leaf spring 208 urges the purge air flow control member 110 to rotate in a counterclockwise direction, as viewed in FIG. 5, about the mounting pin 178. The purge air flow control member 110 is pivotal in a clockwise direction from the unactuated condition shown in FIG. 5 toward an actuated condition against the influence of the leaf spring 208.

The leaf spring 208 has an arcuate projection 210 which actuates the membrane switch assembly 124 when the purge air flow control member 110 is manually pivoted from the unactuated condition (FIG. 5) toward the actuated condition against the influence of the leaf spring. Thus, as manual pressure is applied against the outer side surface 196 on the front wall 194 of the purge air flow control member 110 by a finger of an operator, the purge air flow control member is pivoted in a clockwise direction (as viewed in FIG. 5) about the mounting pin 178 against the influence of the leaf spring 208. As this occurs, the leaf spring 208 is resiliently deflected and the projection 210 actuates the membrane switch assembly 124.

Figure 5:
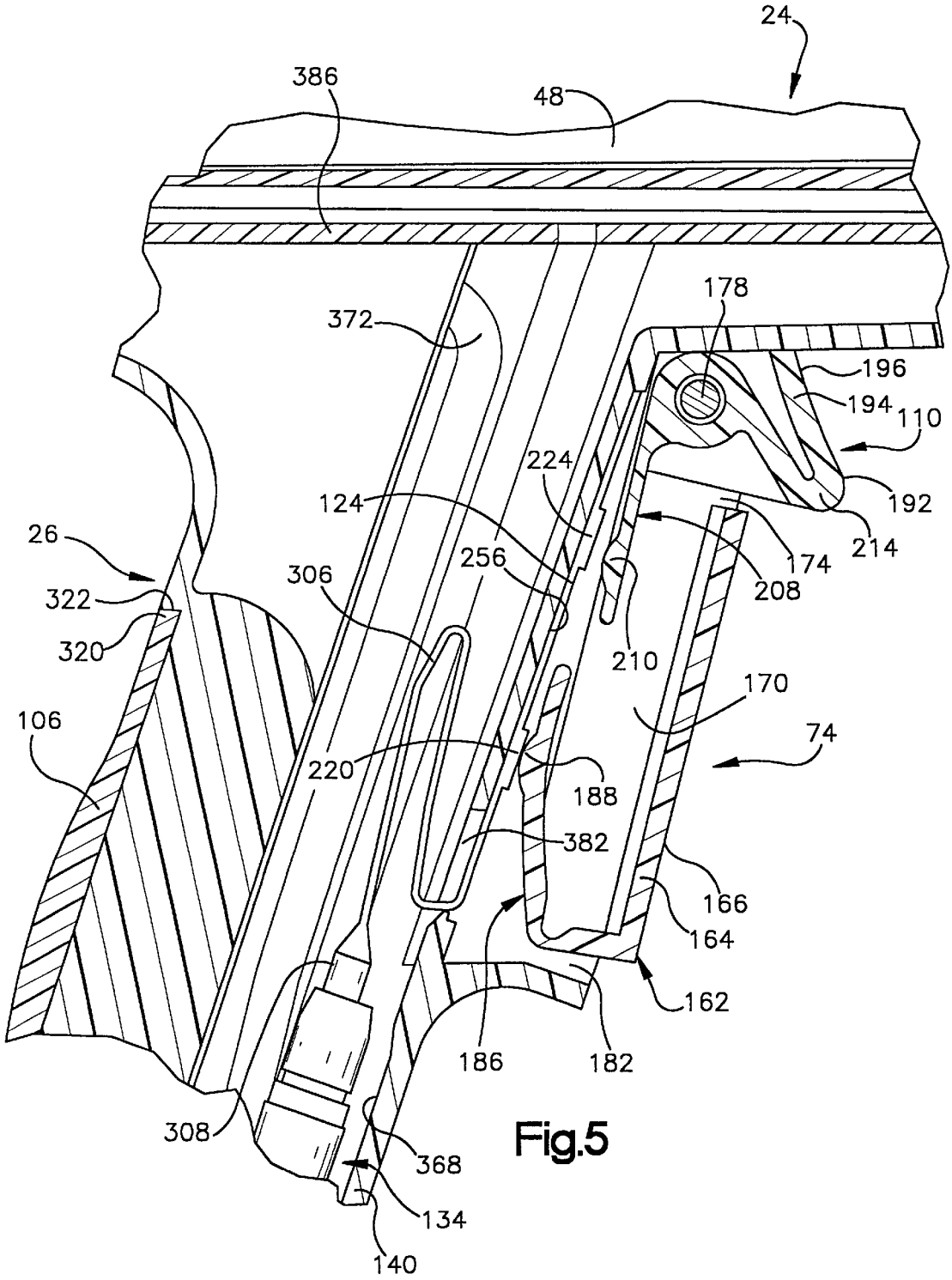
FIG. 5 is an enlarged fragmentary sectional view illustrating the relationship between a coating material flow control member or main trigger and a purge air flow control member or secondary trigger disposed on the handle portion of the spray gun.

The purge air flow control member 110 is nested between the arms 172 and 174 (FIG. 4) on the coating material flow control member 74 (FIG. 5). Both the purge air flow control member 110 and the coating material flow control member 74 are disposed in the recess 182. The purge air flow control member 110 is vertically (as viewed in FIG. 5) aligned with the coating material flow control member 74 in the recess 182 in the handle portion 26 of the spray gun 24.

Although the purge air flow control member 110 is aligned with the coating material flow control member 74, a nose portion 214 on the body 192 of the purge air flow control member 110 extends outward of the outer side surface 166 on the coating material flow control member. Thus, the purge air flow control member 110 projects to the right (as viewed in FIG. 5) of the coating material flow control member 74. By having the purge air flow control member 110 project outward of the coating material flow control member 74, the possibility of unintentional actuation of the purge air flow control member 110 is minimized. Thus, the fingers on the hand of an operator engaging the coating material flow control member 74 are blocked from accidentally sliding upward (as viewed in FIG. 5) into engagement with the purge air flow control member 110 by the outwardly projecting nose portion 214 of the purge air flow control member.

Membrane Switch Assembly

The membrane switch assembly 124 (FIG. 5) is actuated by either the coating material flow control member 74 or the purge air flow control member 110. The membrane switch assembly 124 includes a lower set of switch contacts 220 (FIGS. 5 and 6) which are actuated by depressing the coating material flow control member 74 against the influence of the leaf spring 186. Similarly, the membrane switch assembly 124 includes an upper set of contacts 224, which are actuated when the purge air flow control member 110 is depressed against the influence of the leaf spring 208.

The membrane switch assembly 124 (FIG. 6) includes an outer electrically insulating layer 228 which is formed of a suitable flexible polymeric material. The outer insulating layer 228 has a rectangular outer major side surface 230 which faces toward the coating material flow control member 74 and purge air flow control member 110 (FIG. 5).

A pair of circular printed circuit elements or contacts 234 and 236 (FIG. 6) are disposed on a rectangular inner side surface 238 of the outer insulating layer 228. The circular printed circuit contact 234 is aligned with the projection 188 (FIG. 5) on the leaf spring 186 of the coating material flow control member 74. The circular printed circuit contact 236 (FIG. 6) is aligned with the projection 210 (FIG. 5) on the leaf spring 208 of the purge air flow control member 110. The two printed circuit contacts 234 and 236 (FIG. 6) are connected to a common lead 242.

A rectangular intermediate or spacer layer 246 (FIG. 6) is disposed between the outer layer 228 and a rectangular inner layer 248. The intermediate layer 246 and inner layer 248 are formed of the same flexible electrically insulating polymeric material as the outer layer 228. A pair of circular openings 250 and 252 are formed in the intermediate layer 246. The openings 250 and 252 are axially aligned with the circular printed contacts 234 and 236.

The electrically insulating inner layer 248 abuts a rectangular inner side surface 256 (FIG. 5) of the rectangular recess 182 in the handle portion 26 of the spray gun 24. A pair of circular printed circuit elements or contacts 260 and 262 (FIG. 6) are disposed on an inner major side surface 264 of the inner insulating layer 248. Separate leads 266 and 268 are connected with the contacts 260 and 262.

The contacts 260 and 262 (FIG. 6) are disposed on the inner insulating layer 248 in axial alignment with the openings 250 and 252 in the intermediate layer 246 and with the circular contacts 234 and 236 on the outer insulating layer 228. A pair of resilient metal dome spring elements or contacts 272 and 274 extend through the openings 250 and 252 in the electrically insulating intermediate layer 246 of the membrane switch assembly 124.

The dome spring contacts 272 and 274 are axially aligned with the contacts on the electrically insulating outer and inner layers 228 and 248. Thus, the dome spring contact 272 is axially aligned with the printed circuit contact 234 on the outer layer 228 and the contact 260 on the inner layer 248. Similarly, the dome spring contact 274 is axially aligned with the printed circuit contact 236 on the outer layer 228 and with the printed circuit contact 262 on the inner layer 248.

Figure 6:
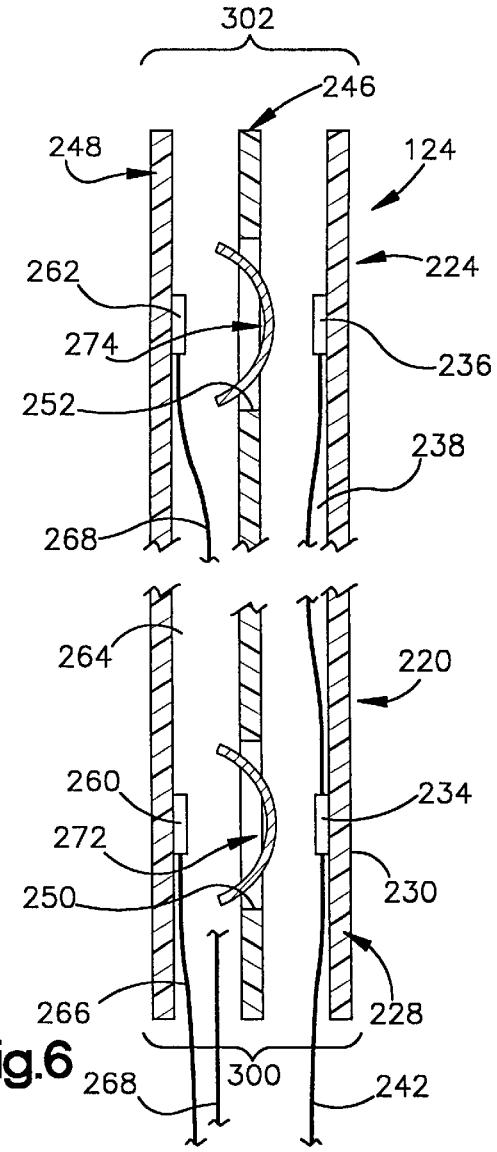
FIG. 6 is a schematic illustration depicting the construction of a membrane switch assembly which is actuated by the coating material flow control member and purge air flow control member of FIG. 5.
Figure 7:
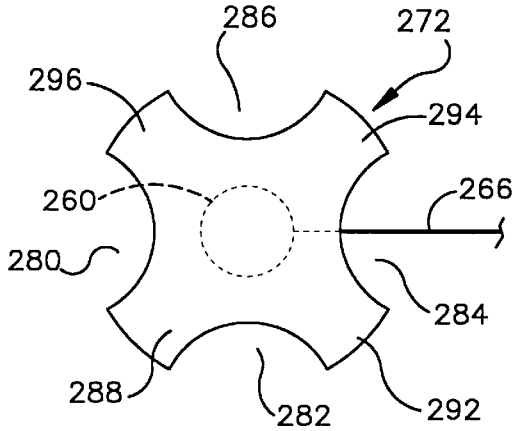
FIG. 7 is a plan view of a dome spring contact utilized in the membrane switch assembly of FIG. 6.

The resilient metal dome spring contact 272 is illustrated in FIG. 7 and includes four arcuate recesses 280, 282, 284 and 286 which are formed in the circular periphery of the dome spring contact 272. This results in the dome spring contact 272 having a plurality of legs 288, 290, 292, 294 and 296. The lead 266 to the lower printed contact 260 on the inner insulating layer 248 extends through the recess 284 between the legs 292 and 294 of the dome spring contact 272. The dome spring contact 272 has a configuration corresponding to the configuration of a portion of a sphere. The dome spring contact 274 (FIG. 6) has the same construction as the dome spring contact 272.

The edge portions of the outer insulating layer 228, intermediate layer 246, and inner insulating layer 248 are sealed together to block contaminants from entering the membrane switch assembly 124. Thus, the edges of the insulating layers 228, 246 and 248 are bonded together in the manner indicated schematically by brackets 300 and 302 in FIG. 6. The bond between the layers 228, 246 and 248 extends completely around the layers so that it is impossible for contaminants to enter between the layers. This results in the membrane switch assembly 124 being usable for a substantial length of time without failure due to fouling by contaminants.

The insulating layers 228, 246 and 248 of the membrane switch assembly 124 have a rectangular configuration which corresponds to and is substantially the same size as the rectangular inner side surface 256 (FIG. 5) of the recess 182. Therefore, the membrane switch assembly 124 is positioned relative to the coating material flow control member 74 and purge air flow control member 110 by the side walls of the recess 182. Since the membrane switch assembly 124 forms a unit, it is readily positioned in the recess 182 (FIG. 5) with a minimum of difficulty during construction of the spray gun 24. The leads 242, 266 and 268 extend through a sheath 306 to a connector 308. The connector 308 is connected with a lead 310 (FIG. 4) which extends into the electrical cable 82.

Upon manual actuation of the coating material flow control member 74 (FIG. 5), the projection 188 on the leaf spring 186 is pressed against the outer side surface 230 (FIG. 6) of the flexible outer layer 228 at a location aligned with the printed circuit contact 234. This force is transmitted through the outer layer 228 and printed circuit contact 234 to the dome spring contact 272. As the coating material flow control member 74 continues to be manually actuated, the leaf spring 186 continues to be resiliently deflected and the force applied against the dome spring contact 272 increases.

When the force applied against the dome spring contact 272 has increased to a predetermined magnitude, the dome spring contact 272 is resiliently snapped to an unstable over center condition in which the dome spring contact 272 engages the contact 260 on the inner layer 248. This completes an electrical circuit between the contact 234 on the outer insulating layer 228 and the contact 260 on the inner insulating layer 248. This results in the transmission of a signal which is conducted over the lead 266 through the electrical cable 82 to the controller 70 in the manner illustrated schematically in FIG. 1. In response to this signal, the controller 70 operates the coating material flow control valve 54 to an open condition to enable coating material to be conducted to the spray gun 24.

Similarly, upon actuation of the purge air flow control member 110 (FIG. 5), the projection 210 on the leaf spring 208 is pressed against the outer side surface 230 (FIG. 6) on the outer insulating layer 228 at a location aligned with the printed circuit contact 236. This presses the printed circuit contact 236 against the dome spring contact 274. As force is manually applied against the purge air flow control member 110, the leaf spring 208 is resiliently deflected and the force applied against the dome spring contact 274 increases.

When the force applied against the dome spring contact 274 (FIG. 6) reaches a predetermined magnitude, the dome spring snaps to an unstable over center condition and engages the contact 262 on the inner insulating layer 248. This completes a circuit between the printed circuit contact 236 on the outer insulating layer 228 and the printed circuit contact 262 on the inner insulating layer 248. The lead 268 is connected with a controller 70 (FIG. 1) through the electrical cable 82. Upon receiving a signal indicating that actuation of the purge air flow control member 110 has effected actuation of the upper set of contacts 224 in the membrane switch assembly 124, the controller 70 opens a valve 116 to enable air to flow through the purge air conduit 118 to the spray gun 24.

Upon releasing of either the coating material flow control member 74 or the purge air flow control member 110 (FIG. 5), the force applied against the associated set of contacts 220 or 224 (FIG. 6) in the membrane switch assembly 124 is interrupted. The dome spring contacts 272 and 274 are stable only when they are in the unactuated condition indicated schematically in FIG. 6. Therefore, as soon as the force against a deflected dome spring contact 272 or 274 is released, the dome spring contact snaps back to its original configuration to open the associated set of contacts 220 or 224.

The leaf springs 186 and 208 (FIG. 5) connected with the coating material flow control member 74 and purge air flow control member 110 have a series relationship with the dome spring contacts 272 and 274 (FIG. 6) in the membrane switch assembly 124. Upon actuation of the coating material flow control member 74, the leaf spring 186 is initially deflected until the force required to deflect the leaf spring is sufficient to cause the dome spring contact 272 to snap to its over center condition. This snapping action of the dome spring contact 272 is perceptible to an operator applying manual force against the coating material flow control member 74 and provides an indication to the operator that the flow of coating material has been initiated.

Similarly, the leaf spring 208 (FIG. 5) connected with the purge air flow control member 110 is disposed in a series relationship with the dome spring contact 274 (FIG. 6) in the upper set of contacts 224. When the purge air flow control member 110 is initially depressed, the leaf spring 208 is deflected. When the leaf spring 208 has been deflected sufficiently to apply a predetermined force to the dome spring contact 274, the dome spring contact snaps over center and closes the upper set of contacts 224. The snapping of the dome spring contact 274 is perceptible to an operator so that the operator realizes that the flow of purge air has commenced.

The specific membrane switch assembly 124 illustrated in FIG. 6 is commercially available from Memtron Technologies Inc. of Frankenmuth, Mich. However, other known types of membrane switch assemblies could be utilized. For example, it is contemplated that the membrane switch assembly 124 could have a pair of flat metal sheets in place of the dome spring contacts 272 and 274. The flat metal sheets would be resiliently deflected from their initial flat configuration to a bowed configuration in order to close the associated set of contacts.

Hand Grips

To enable the spray gun 24 to be comfortably used by operators having different sized hands, a plurality of hand grips 106 and 126 (FIG. 4) of different sizes can be used with the handle portion 26 of the spray gun. When the operator has a relatively small hand, the small hand grip 106 is connected with the handle portion 26 of the spray gun. When the operator has a relatively large hand, the large hand grip 126 is connected with the handle portion 26 of the spray gun.

The hand grips 106 and 126 are formed of an electrically conductive material. In the illustrated embodiment of the invention, the hand grips 106 and 126 are formed of carbon filled PBT (polybutylene terephthalate). This electrically conductive material is commercially available from RTP Company of Winona, Minn. However, it should be understood that the hand grips 106 and 126 could be formed of other electrically conductive materials if desired. Although only two hand grips 106 and 126 have been illustrated in FIG. 4, it should be understood that a greater number of hand grips could be provided if desired.

The selected hand grip 106 or 126 is releasably held against movement relative to the base section 30 of the handle portion 26. When the hand grip 106 is selected, an upper end portion 320 of the hand grip (FIG. 5) is engaged by an undercut 322 formed in the handle portion 26 of the spray gun 24. The undercut 322 holds the upper end portion 320 of the hand grip against movement toward the left (as viewed in FIG. 5) relative to the handle portion 26 of the spray gun 24.

Figure 8:
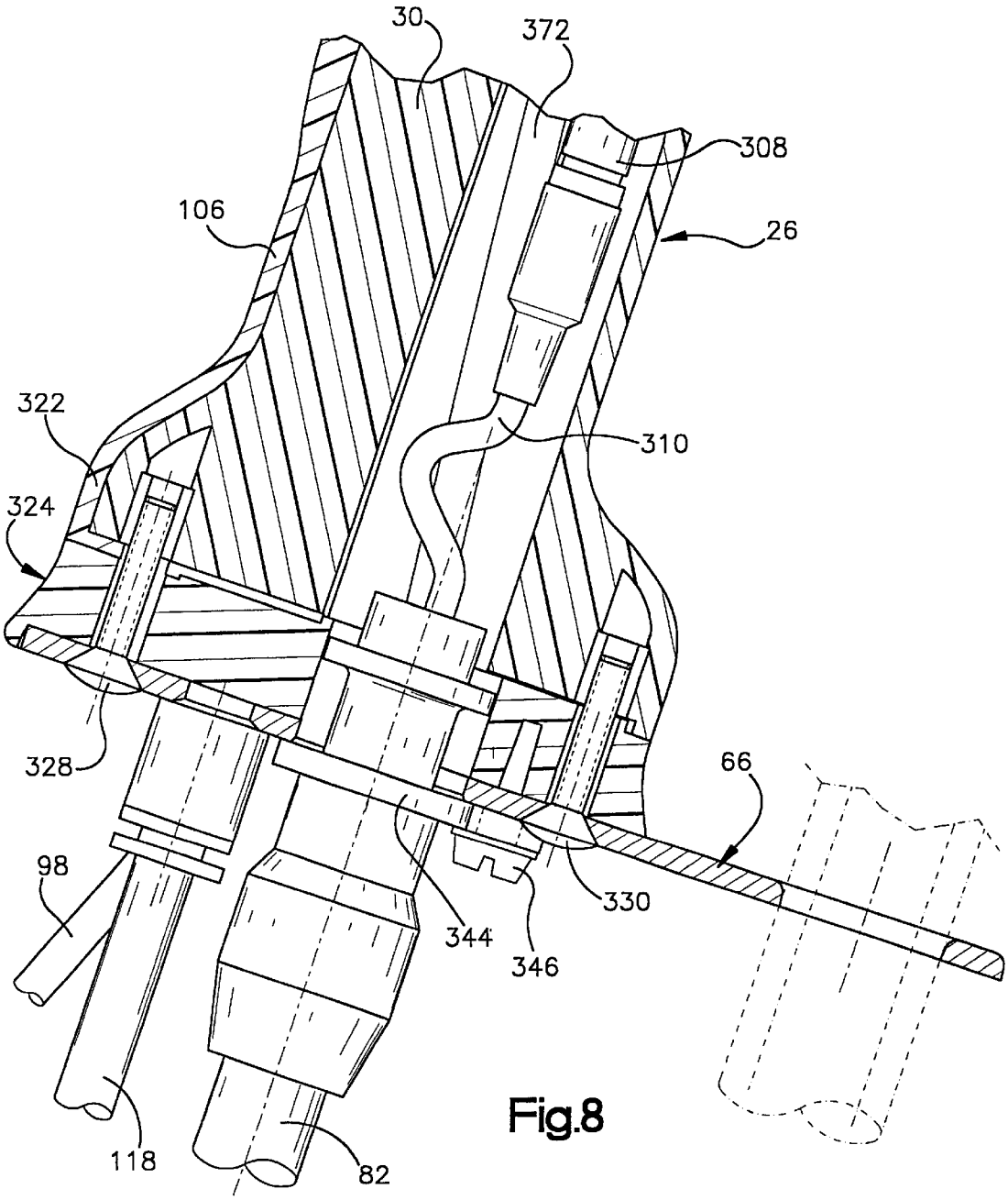
FIG. 8 is an enlarged fragmentary sectional view of an end portion of the handle portion of the spray gun of FIG. 2 and illustrating the manner in which air conduits, an electrical cable, and a selected hand grip are connected with the handle portion of the spray gun.

A lower end portion 322 (FIGS. 4 and 8) of the hand grip 106 is clamped between an electrically conductive base plate 324 and a lower (as viewed in FIG. 8) end of the electrically insulating base section 30 of the handle portion 26. Thus, a pair of mounting screws 328 and 330 clamp the coating material bracket 66 and the base plate 324 firmly against the lower end of the handle portion 26. The lower end portion 322 of the hand grip 106 is disposed between the base plate 324 and the lower end of the handle portion 26. Therefore, when the mounting screw 328 is tightened, the lower end portion 322 of the hand grip 106 is firmly clamped in place on the handle portion 26.

At this time, the upper end portion 320 of the hand grip 106 is disposed in the undercut 322 (FIG. 5). Therefore, opposite ends of the hand grip 106 are held against movement relative to the handle portion 26 of the spray gun 24. This results in the hand grip 106 being firmly connected with the handle portion 26 of the spray gun and held in place during use of the spray gun.

When the small hand grip 106 is to be removed and the large hand grip 126 substituted in its place, it is merely necessary to loosen the mounting screw 328. Loosening the mounting screw 328 allows the lower end portion 322 of the hand grip 106 to be slid out from between the base plate 324 and the lower (as viewed in FIG. 8) end of the handle portion 26. As this occurs, the hand grip can be moved axially downward (as viewed in FIGS. 5 and 8) to disengage the upper end portion 320 (FIG. 5) of the hand grip 106 from the undercut 322.

Once the small hand grip 106 has been disconnected from the handle portion 26, the large hand grip 126 can be connected with the handle portion. When the large hand grip 126 is to be connected with the handle portion, an upper end 336 (FIG. 4) of the hand grip 126 is moved into the under cut 322 (FIG. 5). The lower end 338 (FIG. 4) of the large hand grip 126 is then moved between the base plate 324 and the lower end of the handle portion 26. The retaining screw 328 is then tightened to clamp the lower end 338 of the hand grip in place.

Regardless of which hand grip 106 or 126 is selected, the hand grip is electrically grounded. To electrically ground the hand grip 106 or 126, a metal bracket 344 on the outside of the electrical cable 82 is connected with the electrical ground 109 (FIG. 1) at a connection (not shown) within the electrical cable 82. The bracket 344 (FIG. 8) is connected with the electrically conductive base plate 324 by a retaining screw 346. The retaining screw 346 extends through the electrically insulating material support bracket 66 into the base plate 324 to ground the base plate.

The base plate 324 is formed of the same electrically conductive material as the hand grips 106 and 126 (FIG. 4). Thus, the base plate 324 is formed of carbon filled PBT. Of course, the base plate 324 could be formed of a different material if desired.

It is preferred to use the hand grips 106 and 126 with a spray gun which is utilized to apply electrostatically charged coating materials to an object. It is believed that the electrical grounding of the electrically conductive hand grips will be particularly advantageous when the associated spray gun is utilized to apply either powder or liquid coating materials which are electrostatically charged. However, it is also believed that the use of different size hand grips 106 and 126 will be advantageous with spray guns which are used to apply coating materials which are not electrostatically charged.

Electrode Wash Air Passage And Electrical Conductor Passage

Air and electrical passages extend from the lower or outer end of the handle portion 26 of the spray gun 24 into the extension portion 28 of the spray gun. The air and electrical conductor passages extend from the base section 32 of the extension portion 28 of the spray gun 24 through the barrel section 36 of the spray gun and exit from the spray gun at the nozzle assembly 42. In the barrel section 36, the electrical conductor passage and one of the air passage are coincident.

The air and electrical passages in the handle portion 26 of the spray gun are formed by cooperation between the inner wall structure 138 (FIG. 10) and the outer wall 140 of the handle portion. The inner wall structure 138 and outer wall 140 of the handle portion 26 of the spray gun 24 are molded as one piece. The purge air passage 130, electrode wash air passage 132, and electrical conductor passage 134 are disposed in a side-by-side relationship in the handle portion 26 of the spray gun 24.

Figure 9:
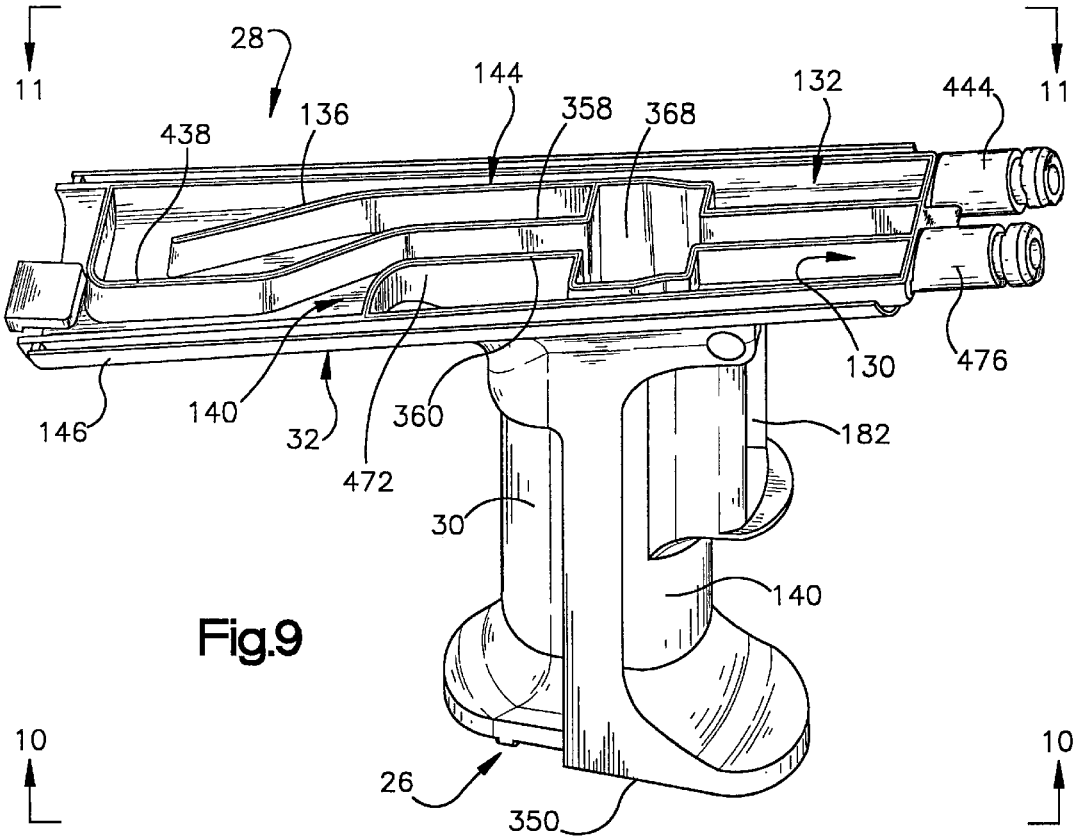
FIG. 9 is a pictorial illustration of the handle portion of the spray gun with components of the spray gun removed.
Figure 10:
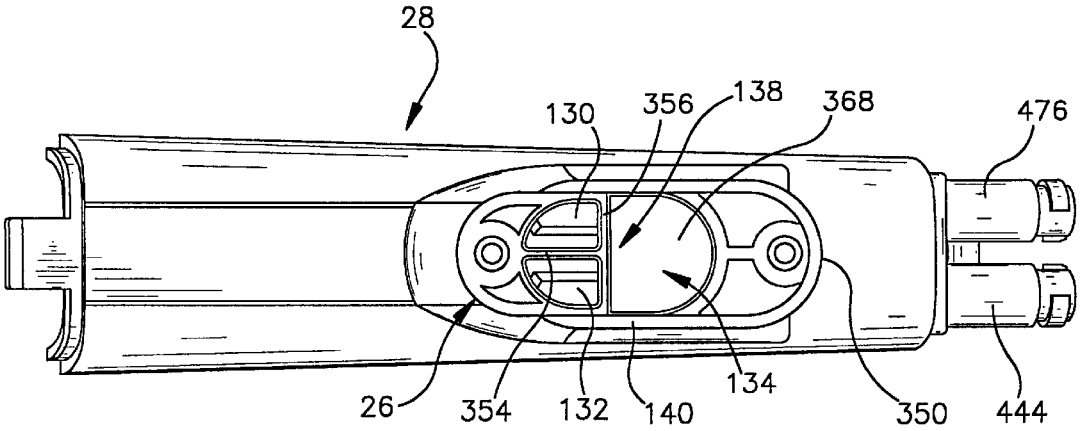
FIG. 10 is a plan view, taken generally along the line 10—10 of FIG. 9, illustrating the manner in which passages are formed by cooperation between an outer wall and an inner wall structure of the handle portion of the spray gun.

The inner wall structure 138 includes a divider wall 354 (FIG. 10). The inner wall structure 138 also includes a cross wall 356 which is intersected by and molded as one piece with the divider wall 354. The divider wall 354 and cross wall 356 extend from the lower end portion 350 (FIGS. 9 and 10) of the handle portion 26 of the spray gun into the extension portion 28 of the spray gun.

As the divider wall 354 approaches the extension portion 28 of the spray gun, the divider wall is bifurcated into two sections 358 and 360 (FIG. 11) which form part of the inner wall structure 144 and extension portion 28. The sections 358 and 360 of the divider wall 354 cooperate to define a portion 364 of the electrical conductor passage 134.

The electrical conductor passage 134 has a relatively large main section 368 (FIG. 10) which extends through the handle portion 26 into the extension portion 28. In the handle portion 26, a longitudinal central axis of the main section 368 of the electrical conductor passage 134 extends parallel to longitudinal axes of the purge air passage 130 and electrode wash air passage 132. However, as the divider wall 354 splits into the two sections 358 and 360 (FIG. 11), the electrical conductor passage 134 bends or turns at a portion 370 of the electrical conductor passage disposed between the sections 358 and 360 of the divider wall 354.

The electrical conductor passage 134 extends to the left (as viewed in FIG. 11) end of the extension portion 28 of the spray gun 24. This enables an electrical conductor 372 (FIGS. 2 and 4) to be connected with an electrical input at the end portion 152 of the voltage multiplier unit 48 (FIGS. 2 and 4). Thus, the conductor 372 ends at a connector 376 which connects the conductor with electrical input terminals at the left (as viewed in FIG. 2) end portion 152 of the voltage multiplier unit 48. The conductor 372 connects the voltage multiplier unit 48 with the source 80 (FIG. 1) of the direct current voltage.

The main section 368 (FIGS. 2 and 10) of the electrical conductor passage 134 has an outlet opening 382 (FIGS. 5 and 11) through which the membrane switch assembly 124 extends. Thus, the main portion of the membrane switch assembly 124 is disposed in the recess 182 (FIG. 5) in the outside of the handle portion 26 of the spray gun 24.

However, the membrane switch assembly 124 extends through the opening 382 in the outer wall 140 of the handle portion 26 into the electrical conductor passage 134. The connector 308 is disposed in the electrical conductor passage 134 and connects the membrane switch assembly 124 with the lead 310 which forms part of the electrical cable 82 (FIG. 4). The lead 310 contains the leads 242, 266 and 268 which are connected with the membrane switch assembly 124 (FIG. 6). The lead 242 is connected with the electrical ground 109 through the cable 82 (FIG. 1). The leads 266 and 268 are connected with the controller 70 through the cable 82.

A panel 386 (FIG. 12) is disposed over the base section 32 of the extension portion 28 of the spray gun 24.

The panel 386 forms portions of the purge air passage 130 and electrode wash air passage 132 (FIG. 11) when the panel is positioned over the base section 32 of the extension portion 28. In accordance with a feature of the present invention, the panel 386 is formed with the opening 154 to expose the end portion 152 of the voltage multiplier unit 48 (FIGS. 2 and 4) to the flow of electrode wash air in the passage 132.

The voltage multiplier unit 48 has an electrically insulating outer housing. However, a metal heat sink (not shown) is provided in the end portion 152 of the voltage multiplier unit 48. The metal heat sink has an outer side surface which is exposed to the flow of electrode wash air through the passage 132 at the opening 154. Components of the oscillator portion of the voltage multiplier unit 48 are connected with the heat sink to promote a heat transfer between the components of the oscillator portion of the voltage multiplier unit 48 and the heat sink.

A cylindrical main section 390 (FIG. 4) of the voltage multiplier unit 48 extends outward from the end portion 152 of the voltage multiplier unit. The cylindrical main portion 390 of the voltage multiplier unit 48 is telescopically received in a cylindrical chamber 392 (FIG. 2) in the housing section 34 of the extension portion 28. The housing section 34 of the extension portion 38 is connected with the outer wall 146 of the base section 32 of the extension portion 28. The voltage multiplier chamber 392 (FIG. 2) is closed by an end cap 398 which is secured to the base section 32 of the extension portion 28. A hook 400 is provided on the end cap 398 to support the spray gun 24.

The output end portion 86 of the voltage multiplier unit 48 is connected with the electrode assembly 46. The electrode assembly 46 includes a tubular housing 404 (FIGS. 2, 13 and 14). The tubular electrode housing 404 encloses a cylindrical voltage conductor 408 which extends from the output end portion 86 of the voltage multiplier unit 48 (FIG. 2) to the nozzle assembly 42. A relatively high electrical voltage is conducted through the conductor 408 to the electrode element 90 (FIG. 2) at the nozzle assembly 42.

The tubular housing 404 (FIG. 13) includes a generally cylindrical connector member 412 which is connected with the output end portion 86 of the voltage multiplier unit 48. The connector member 412 is disposed in the barrel section 36 of the extension portion 28. A tubular main section 414 of the electrode housing 404 is connected with the connector member 412 and extends from the connector member to the nozzle assembly 42 (FIG. 14).

At the nozzle assembly 42 (FIGS. 2 and 14), the main section 414 of the housing 404 is connected with a spider or support member 418 in the nozzle assembly 42. The spider 418 cooperates with a nozzle member 420 to define a path 422 having an annular cross sectional configuration and along which fluid (air) entrained coating material (powder) is conducted through the nozzle 420. A deflector 424 is provided at the axially outer end of the nozzle 420 to deflect the flow of fluid entrained coating material. A cylindrical wall 428 extends around a portion of the deflector 424 and cooperates with the deflector to shape the flow of air entrained powder from the nozzle assembly 42.

It should be understood that the nozzle assembly 42 could have any one of many different known constructions. For example, the construction disclosed in the aforementioned U.S. Pat. No. 5,056,720 issued Oct. 15, 1991.

The electrode wash air passage 132 extends from the lower end portion 350 (FIGS. 9 and 10) of the handle portion 26 through the extension portion 28 and through the nozzle assembly 42. The electrode wash air passage 132 extends through the handle portion 26 to an entrance 432 (FIG. 11) to an initial section 434 of the electrode wash air passage 132 disposed in the base section 32 of the extension portion 28. The initial section 434 of the electrode wash air passage 132 is formed between a pair of ribs or walls 436 and 438. The walls 436 and 438 are integrally molded as one piece with the outer wall 146 of the extension portion 28 and with the handle portion 26 of the spray gun 24.

The walls 436 and 438 direct the flow of electrode wash air from the handle portion 26 rearward, that is toward the left as viewed in FIG. 11, to the opening 154 (FIG. 12) in the panel 386. As the electrode wash air flows around a rearward end of the wall 436 (FIGS. 11 and 12), the electrode wash air engages the rearward end portion 152 of the voltage multiplier unit 48 (FIG. 2) at the opening 154. Exposure of the voltage multiplier unit 48 to the flow of electrode wash air transfers heat from the voltage multiplier unit to the electrode wash air. Although only the end portion 152 (FIG. 2) of the voltage multiplier unit 48 is engaged by the electrode wash air at the opening 154 in the panel 386 (FIG. 12), a larger opening could be provided if desired to expose a larger surface area on the voltage multiplier unit to the flow of electrode wash air.

After flowing around the rearward (left as viewed in FIG. 11) end of the wall 436, the electrode wash air flows between the wall 436 and the outer wall 146 along a section 442 of the electrode wash air passage 132. The electrode wash air then flows into a tubular cylindrical outlet connector 444 (FIGS. 9 and 11). The outlet connector is molded as one piece with the outer wall 146 of the extension portion 28. The direction of flow of the electrode wash air through the sections 434 and 442 of the electrode wash air passage 132 has been indicated schematically by arrows 446 in FIG. 11.

The walls of the electrode wash air passage 132 cooperate with the outer wall 146 of the extension portion 28 to at least partially define portions of both the electrode wash air passage 132 and the electrical conductor passage 134. The wall 438 (FIG. 11) is formed as a continuation of the section 358 of the divider wall 354 (FIG. 10) which extends through the handle portion 26. This results in the wall 438 defining both a portion of the electrical conductor passage 134 and a portion of the electrode wash air passage 132.

The panel 386 (FIG. 12) abuts the longitudinally extending upper edges of the walls 436 and 438 (FIG. 11). The flat panel 386 close off the electrode wash air passage 132 from the electrical conductor passage 134. Thus, even though the voltage multiplier unit 48 is exposed to the flow of electrode wash air through the passage 132, the electrode wash air is confined to the passage 132 and can not move into the electrical conductor passage 134.

The outlet connector 444 is telescopically received in a passage (not shown) molded in the body of the barrel section 36 of the extension portion 28. The passage in which the outlet connector 444 is telescopically received has an outlet 452 (FIG. 13) to a cylindrical chamber 454 which forms a portion of the electrode wash air passage 132. The connector member 412 of the electrode housing 404 is disposed in the chamber 454.

A radially extending passage 458 (FIG. 13) is formed in a cylindrical wall of the connector member 412 to enable electrode wash air to flow from the chamber 454 into the passage 102 which extends around the voltage conductor 408. The passage 102 forms a portion of both the electrical conductor passage 134 and the electrode wash air passage 132. The passage 102 extends axially along the housing 404 from the voltage multiplier unit 48 to the nozzle assembly 42.

In the extension portion 28, the electrode wash air flows from the base section 32 to the chamber 454 in the barrel section of the extension portion 28. The electrode wash air then flows through the passage 458 to the passage 102 which extends axially along the voltage conductor 408 to the nozzle assembly 42. As the electrode wash air moves through the passage 102 along the cylindrical outer side surface of the electrical conductor 408, any contaminants adjacent to the outer surface of the voltage conductor 408 are washed away.

The electrode wash air flows from the main section 414 of the housing 404 into the spider 418 of the nozzle assembly 42 (FIG. 14). The electrode wash air then flows along the outer side surface of the electrode element 90 and through the deflector 424 (FIG. 14) to the environment adjacent to the deflector. This flow of electrode wash air is effective to remove contaminants from adjacent to the electrode assembly 46.

The electrode wash air flows from the source 96 (FIG. 1) through the conduit 98 to the handle portion 26 of the spray gun 26. The electrode wash air then flows through the handle portion 26 and then through the extension portion 28. As the electrode wash air flows through the spray gun 24, the electrode wash air is effective to cool the voltage multiplier unit 48. In addition, the electrode wash air is effective to remove contaminants from around the electrode assembly 46. The electrode wash air also prevents powder buildup at the electrode element 90 (FIG. 14).

Purge Air Passage

The purge air passage 130 (FIG. 10) extends from the lower end portion 350 of the handle portion 26, through the base section 32 of the extension portion 28 (FIG. 9), and through the barrel section 36 (FIG. 2) of the extension portion 28 to the nozzle assembly 42. The purge air passage 130 extends through the nozzle assembly 42 to the environment around the spray gun 24. In the barrel section 36 and nozzle assembly 42 of the spray gun 24, the purge air passage 130 is coincident with the path of flow of air entrained coating material through the barrel section 36 and nozzle assembly 42 to enable the purge air to remove excess coating material from the spray gun 24.

In the handle portion 26 of the spray gun 24, the purge air passage 130 is defined by cooperation between the inner wall structure 138 and the outer wall 140 (FIG. 10) of the handle portion. Throughout the extent of the handle portion 26, the purge air passage 130 is separated from the electrode wash air passage 132 by the divider wall 354. The cross wall 356 is molded as one piece with the outer wall 140 of the handle portion 26 and cooperates with the divider wall 354 to define the purge air passage 130 and the electrode wash air passage 132.

The purge air passage 130 has an entrance 468 (FIG. 11) to the base section 32 of the extension portion 28. A wall 472 forms a portion of the inner wall structure 144 of the base section 32. The wall 472 is molded as one piece with the outer wall 146 of the base section 32 and is an extension of the section 360 of the divider wall 354 between the purge air passage 130 and the electrode wash air passage 132. The purge air flows from the entrance 468 at the portion of the purge air passage 130 disposed in the base section 32 to a cylindrical outlet connector 476 (FIGS. 9 and 11) which is telescopically received in a portion 478 (FIG. 13) of the purge air passage 130.

The portion 478 of the purge air passage 130 is molded into the barrel section 36. The portion 478 of the purge air passage 130 is connected with the inlet passage 60 (FIG. 13) through which coating material is conducted. Thus, the coating material is conducted from the coating material conduit 56 through the adapter 58 into the inlet passage 60. The purge air flows into a cylindrical portion 484 of the purge air passage 130 which extends around the adapter 58. From the cylindrical portion 484 of the purge air passage 130, the purge air flows into the inlet passage 60.

The portion 484 of the purge air passage 130 which extends around the adapter 58 has an annular configuration with a central axis which is coincident with the central axis of the inlet passage 60. Therefore, the adapter 58 is effective to direct the flow of purge air along the cylindrical inner side surface of the inlet passage 60 to remove any particles of coating material (powder) which may adhere to the inner side surface of the inlet passage 60. The purge air then flows from the inlet passage 60 into the main coating material passage 62.

The purge air flows along the main coating material passage 62 through the nozzle assembly 42 to the environment around the spray gun 24. As the purge air flows along the main coating material passage 62, the purge air is effective to remove any particles of coating material (powder) which may adhere to the cylindrical inner side surface of the main coating material passage. In addition, as the purge air flows through the nozzle assembly 42, the purge air is effective to remove any particles of coating material which may adhere to the inner side surface of the nozzle 420 (FIG. 14) and/or to the outer side surface of the spider 418. In addition, the purge air will remove excess powder from the outer side surface of the deflector 424.

The purge air pressure is greater than the electrode wash air pressure. This is because the flow of purge air must wash away particles and/or clumps of powder from the coating material passages 60 and 62 and from the nozzle assembly 42. For example, in one specific embodiment of the spray gun 24, the purge air pressure was approximately 90 psi while the electrode wash air pressure was approximately 5 psi.

Spray Gun Balance

In order to increase operator comfort, the spray gun is balanced. Thus, the center of gravity of the extension portion 28 (FIG. 2) of the spray gun 24 is disposed directly above the handle portion 26 of the spray gun. The center of gravity of the extension portion 28 of the spray gun is advantageously disposed on the longitudinal central axis of the handle portion 26. Therefore, the portion of the spray gun which extends toward the right (as viewed in FIG. 2) from the handle portion 26 of the spray gun 24 has the same weight as the portion of the extension portion 28 which extends toward the left of the handle portion 26.

The voltage multiplier unit 48 extends through the central axis of the handle portion 26 of the spray gun 24. The distance which the voltage multiplier unit 48 is offset toward the left (as viewed in FIG. 2) of the handle portion 26 is greater than the distance which the voltage multiplier unit 48 is offset toward the right from the handle portion 26. This enables the relatively heavy portion of the voltage multiplier unit 48 which extends from the handle portion 26 in a direction away from the nozzle assembly 42 to counterbalance the weight of the barrel section 36 and nozzle assembly.

Operation

When operation of the spray gun 24 is to be initiated, the coating material flow control member 74 is manually actuated. Manual operation of the coating material flow control member 74 is effective to close the lower set 220 (FIGS. 5 and 6) of contacts in the membrane switch assembly 124. This results in the transmission of a signal over the lead 266 (FIG. 6) through the electrical cable 82 (FIG. 1) to the controller 70 to initiate operation of the spray gun 24. At this time, the purge air flow control member 110 is in an unactuated condition and the upper set 224 (FIGS. 1 and 6) of contacts are in an open condition. In response to the signal over the lead 266, the controller closes the switch 78 (FIG. 1) to connect the low voltage source 80 with the voltage multiplier unit 48. The output from the voltage multiplier unit 48 charges the electrode assembly 46.

The controller 70 also operates the electrode wash air control valve 94 (FIG. 1) to an open condition. This results in a flow of electrode wash air being conducted through the conduit 98 to the electrode wash air passage 132 (FIG. 10) in the handle portion 26 of the spray gun 24. The electrode wash air is conducted through the electrode wash air passage 132 past the exposed portion of the voltage multiplier unit 48 and into the barrel section 36 of the extension portion 28 of the spray gun 24. The electrode wash air then flows into the passage 102 extending through the electrode housing 404 and along the outside of the voltage conductor 408 to the nozzle assembly 42.

In addition, the controller 70 operates the coating material flow control valve 54 to an open condition. Powder entrained in a flow of air under pressure is conducted through the coating material supply conduit 56 to the extension portion 28 of the spray gun 24. The air entrained coating material (powder) is conducted along the main coating material passage 62 and through the nozzle assembly 42. As the coating material emerges from the nozzle assembly 42, it enters an electrical field emanating from the electrode element 90. This electrical field is effective to electrostatically charge the particles of coating material in a known manner.

When operation of the spray gun 24 is to be interrupted, a coating material flow control member 74 is released. When this occurs, the leaf spring 186 (FIG. 5) returns the coating material flow control member 74 to its unactuated position and interrupts the application of force against the membrane switch assembly 124. As this occurs, the dome spring contact 272 in the membrane switch assembly 124 snaps back to its original position and the lower set 220 of contacts open. Opening the lower set of contacts 220 in the membrane switch assembly 124 causes the controller 70 to close the coating material flow control valve 54, to open the switch 78 to disconnect the voltage source 80 from the voltage multiplier unit 48 and to operate the electrode wash air control valve 94 to a closed condition. This interrupts the application of coating material to the object.

If the operator desires to clean the coating material passages 60 and 62 and the nozzle assembly 42 (FIG. 2), the operator manually actuates the purge air flow control member 110. This closes the upper set 224 (FIG. 6) of contacts in the membrane switch assembly 124. In response to closing of the contacts 224 in the membrane switch assembly 124, the controller 70 operates the purge air flow control valve 116 to an open condition. The purge air then flows through the purge air passage 130. This flow of purge air is conducted through the coating material inlet passage 60 (FIG. 2), main coating material passage 62 and through the nozzle assembly 42 to remove any particles of powder which may have adhered to these components of the spray gun 24.

Conclusion

In view of the foregoing description, it is apparent that the present invention provides a new and improved apparatus 20 for use in applying coating material to an object includes a spray gun 24 having a handle portion 26 and an extension portion 28 which extends outward from the handle portion. A nozzle 42 is connected with the extension portion 28 to direct a flow of coating material toward the object. A coating material flow control member 74 is disposed on the handle portion 26 of the spray gun 24 to control the flow of coating material. An electrode 90 may be provided adjacent to the nozzle to electrostatically charge the coating material.

In accordance with one of the features of the present invention, an air flow control member 110 is also disposed on the handle portion 26. The air flow control member 110 is manually operable to direct a flow of air through coating material passages 60 and 62 and the nozzle 42 to remove excess coating material from the passages and/or nozzle.

In accordance with another feature of the invention, membrane switch assembly 124 is actuated upon manual actuation of one of the flow control members 74 or 110. The membrane switch assembly includes a switch element 272 or 274 which is disposed between layers 228 and 248 of electrically insulating material. Upon manual actuation of a flow control member 74 or 110, the switch element 272 or 274 is deflected to initiate a control function.

In accordance with another feature of the invention, hand grips 106 and 126 of different sizes may be utilized with the handle portion of the spray gun 24. The hand grips 106 and 126 of different sizes enable the spray gun 24 to be adapted for manual engagement by operators having hands of different sizes. Each of the hand grips 106 or 126 may be formed of an electrically conductive material and, when connected with the handle portion 26 of the spray gun 24, is connected with an electrical ground.

In accordance with another feature of the invention, passages 130, 132 and 134 in the handle and/or extension portions 26 and 28 of the spray gun are formed by cooperation between an outer wall 140 or 146 of the spray gun 24 and an inner wall structure 138 or 144. The inner wall structure 138 and/or 144 may be, at least partially, formed as one piece with the outer wall 140 and/or 146 of the spray gun 24. The inner wall structure 138 and/or 144 may advantageously be utilized to form one or more passages 130, 132 and/or 134 which may conduct purge air, electrode wash air, or electrical conductors.

In accordance with another feature of the invention, a voltage multiplier unit 48 is cooled by a flow of air. To promote a transfer of heat from the voltage multiplier unit to the air, a portion of an outer surface area on the voltage multiplier unit is exposed to the flow of air through a passage 132 in the spray gun 24. The voltage multiplier unit 48 is advantageously positioned to balance the weight of the spray gun 24.

Having described the invention, the following is claimed:

1. A spray gun for use in applying coating material to an object, said spray gun comprising:

a handle portion, an extension portion which is connected with said handle portion, a nozzle connected with said extension portion, an electrode disposed adjacent to said nozzle and away from which electrostatically charged coating material flows toward the object, a coating material passage in said extension portion;

a first switch mounted upon said spray gun and operable to initiate a flow of coating material from said coating material passage in said extension portion through said nozzle toward the object, and a second switch mounted upon said spray gun and operable to initiate a flow of purge air through said coating material passage in said extension portion through said nozzle to remove coating material from said spray gun.

2. The apparatus of claim 1 wherein said one or more passages extend into said extension portion.

3. The apparatus of claim 1 wherein said one or more passages in an air passage connected to a source of air pressure.

4. The apparatus of claim 1 wherein said one or more passages is an electrode wash air passage.

5. The apparatus of claim 1 wherein said one or more passages is an electrical conductor passage.

6. The apparatus of claim 1 wherein at least one of said one or more passages are formed by an inner wall structure and an outer wall of the spray gun.

7. The apparatus of claim 6 wherein said inner wall structure is integrally molded with said outer wall.

8. A spray gun and air line assembly for use in applying electrostatically charged coating material to an object, said spray gun having a handle portion which is manually engageable and an extension portion, a coating material passage within said extension portion, a nozzle connected with said extension portion to direct a flow of particulate coating material from said coating material passage through said nozzle and toward the object, said nozzle having an electrode at least partly disposed therein, a first air line connected to the bottom of said handle portion, said air line connected a first passage formed up through said handle, sad first passage formed at least in part by wall sections formed as one piece with said handle portion, said first passage connected to a second passage in extension portion, said electrode at least partially disposed within said second passage and being washed with at from said first air line.

9. The spray gun of claim 8, further comprising a second air line connected to the bottom of said handle portion, said second air line connected to a third passage formed up through said handle, said third passage formed at least in part by wall sections formed as one piece with said handle portion, said third passage connected to said coating material passage in said extension portion with the air from said second air line passing through said coating material passage and said nozzle to purge said spray gun.

* * * * *